US006834456B2

(12) United States Patent
Murello

(10) Patent No.: US 6,834,456 B2
(45) Date of Patent: Dec. 28, 2004

(54) RECOIL PAD DEVICE

(75) Inventor: Johannes Murello, Deisslingen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 41 days.

(21) Appl. No.: 10/455,920

(22) Filed: Jun. 5, 2003

(65) Prior Publication Data

US 2003/0226304 A1 Dec. 11, 2003

Related U.S. Application Data

(63) Continuation of application No. PCT/EP01/14167, filed on Dec. 4, 2001.

(30) Foreign Application Priority Data

Dec. 7, 2000 (DE) ..... 100 60 906

(51) Int. Cl.[7] ..... F41C 23/00
(52) U.S. Cl. ..... 42/74
(58) Field of Search ..... 42/74

(56) References Cited

U.S. PATENT DOCUMENTS 1,774,060 A 8/1930 Hodge ..... 42/74
2,438,142 A 3/1948 Brower ..... 42/74
3,852,904 A 12/1974 Drevet ..... 42/74
4,683,671 A 8/1987 Farrar ..... 42/74
4,982,521 A 1/1991 Sutton et al. ..... 42/74
6,305,115 B1 * 10/2001 Cook ..... 42/74
6,594,935 B2 * 7/2003 Beretta ..... 42/74

FOREIGN PATENT DOCUMENTS

FR 2167317 8/1973

OTHER PUBLICATIONS

English Translation of International Preliminary Examination Report from International Application No. PCT/EP01/14167, Feb. 21, 2003.

International Search Report from International Application No. PCT/EP01/141767, Mar. 13, 2002.

* cited by examiner

*Primary Examiner*—J. Woodrow Eldred
(74) *Attorney, Agent, or Firm*—Grossman & Flight, LLC

(57) ABSTRACT

Firearms and recoil pad devices for use with firearms are disclosed. An example recoil pad device includes a pad having a working surface which increases by more than approximately 15% when moving from a first condition in which the pad is pressed against a shooter and a second condition when the firearm is fired.

11 Claims, 3 Drawing Sheets

(A - A)

RECOIL PAD DEVICE

RELATED APPLICATION

This patent arises from a continuation of international patent application serial number PCT/EP01/14167, which was filed on Dec. 4, 2001 and has a priority date of Dec. 7, 2001.

FIELD OF THE DISCLOSURE

This disclosure relates generally to firearms, and, more particularly, to a recoil pad device for use with a firearm.

BACKGROUND

Firearms release significant recoil forces upon firing. These forces accelerate the weapon opposite the firing direction, (i.e. toward the body of the shooter). If the firearm is spaced from the shooter when the acceleration occurs, the rearward acceleration can cause the weapon to strike the body of the shooter, which may cause significant pain. To prevent this pain, the shooter presses the weapon against his body when aiming; specifically the user presses the weapon against the shoulder.

In order to decrease the recoil forces released against the body of the shooter, it has been proposed that the weapon housing be provided with a recoil pad device. The recoil pad device is situated between the body of the shooter and the weapon housing when the weapon is aimed. The recoil pad device absorbs a portion of the recoil energy released when a shot is fired.

For example, a recoil pad device is described in German patent publication DE-T2 694 04 0180. That recoil device is created in the form of a pocket that is affixed to the shoulder piece of a rifle. The pocket consists of a material that is only slightly flexible or even rigid, (e.g. the material may be made of cloth filled with viscoelastic rubber).

Another recoil pad device is known from U.S. Pat. No. 4,683,671. That recoil pad device is fastened to a rifle. The recoil pad device includes an elastic exterior casing that has a square cross-section. The exterior casing is filled with a shock absorbing material.

FIG. 10 of French patent FR 2,167,317 shows a recoil pad for a rifle stock that has a rubber cap that creates pliability in the blank spaces in the shooting direction upon firing the weapon. The associated resting surface on the shoulder of the shooter, (i.e., the working surface), barely increases when the weapon is fired.

The same point applies to U.S. Pat. No. 2,438,142 in which the recoil pad is created by an air pillow. The air pillow is enclosed by a stiff casing that sharply restricts the increase in the working surface when a shot is fired.

DETAILED DESCRIPTION

Figure 1:
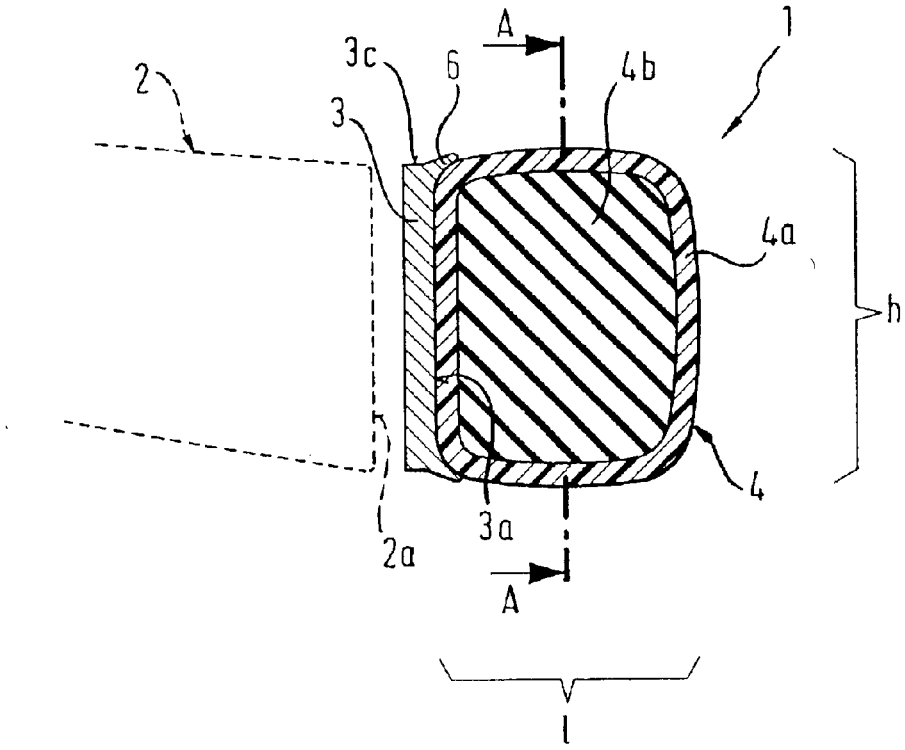
FIG. 1 is a cross-sectional view taken through an example recoil pad device shown in an initial unloaded condition.

FIG. 1 is a cross sectional view through an example recoil pad device 1. The recoil pad device 1 is shown in an initial, unloaded condition in FIG. 1.

The pad device 1 illustrated in FIG. 1 has a carrier plate 3 made of metal or synthetic material on its front end (displayed on the left in the illustration). This carrier plate 3 may be rested or screwed on the back end surface 2*a* of a shoulder piece 2 of a weapon (displayed in dotted lines in the illustration). From the back exterior edge of the carrier plate 3 outward, (i.e., facing to the right in the illustration), there is a groove 6. This groove is configured integrally with the carrier plate 3, tapers toward the back, and is angled against the exterior surface 3*c* of the carrier plate 3 outward.

The recoil pad device 1 illustrated in FIG. 1 also has a pad element 4, which includes an elastomer casing 4*a* and a shock-absorbing element 4*b*. The elastomer casing 4*a* has an even thickness of approximately 0.5 cm and encases the shock-absorbing element 4*b*. The interior surface of the casing 4*a* and the exterior surface of the element 4*b* engage each other and are connected in contact with each other. The illustrated shock-absorbing element 4*b* is configured as one piece and is constructed of a shock-absorbing material such as rubber. The front end surface of the elastomer casing 4*a* is glued or sprayed on to the back end surface 3*a* of the carrier plate 3 and the interior surface of the groove 6. The exterior contours of the elastomer casing 4*a* and the shock-absorbing element 4*b* are generally square with rounded comers and exterior edges that bow slightly outward in the unloaded condition (illustratively the condition shown in FIG. 1 in cross-section). In the unloaded condition, the pad element 4 has a length l of approximately 6 cm, a height h of approximately 8 cm, and a width b of approximately 4 cm as shown in FIG. 4.

Figure 4:
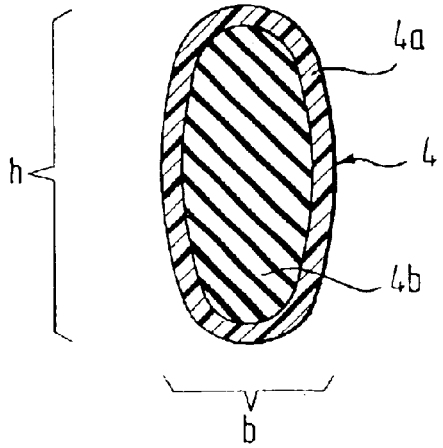
FIG. 4 is a cross-sectional view taken through the example pad device of FIGS. 1–3 and showing the pad device in the condition of FIG. 1.

The elastomer casing 4*a* and the shock-absorbing element 4*b* are generally oval as shown in FIG. 4. The exterior contour of the elastomer casing 4*a* generally corresponds in shape and size to the groove 6 of the carrier plate 3 shown in FIG. 1 and the back end surface 2*a* of the rifle shoulder piece 2.

Before using the rifle, the illustrated pad device 1 is rested on the back end surface 2*a* of the rifle shoulder piece 2, (i.e. connected solidly with the rifle (FIG. 2)) using a resting connection (not displayed) such as glue or mechanical fasteners. When the shooter aims the rifle, he/she presses the illustrated recoil pad device 1 back against his/her shoulder 7, (i.e. in the direction of arrow P in FIG. 2). The rearward force pressing the weapon against the shooter's shoulder slightly distorts the elastomer casing 4*a* and the shock-absorbing element 4*b*. The pad element 4 then has a length l of approximately 5 cm and the back end surface 4*a* of the pad element 4 adjusts ergonomically to the front shoulder surface 7*a*.

Figure 5:
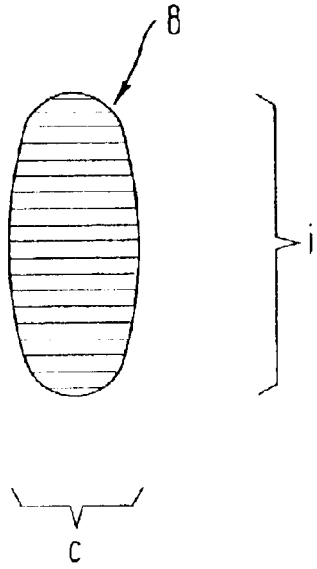
FIG. 5 illustrates the working surface of the pad device of FIGS. 1–4 in the second condition shown in FIG. 2 in which the surface is pressed against the shoulder of a shooter when aiming a weapon.

When aiming the weapon in this fashion, the working surface 8, (i.e., in this example, the portion of the exterior surface of the elastomer casing 4*a* touching the front shoulder surface 7*a* of the shooter), has a height i of approximately 7 cm and, as shown in FIG. 5, a width c of approximately 3 cm. The exterior contour of the working surface 8 is generally oval. Due to the aforementioned ergonomic adjustment of the pad element 4, the working surface 8 engaging the shooter is bowed slightly inward (see FIG. 2).

Figure 2:
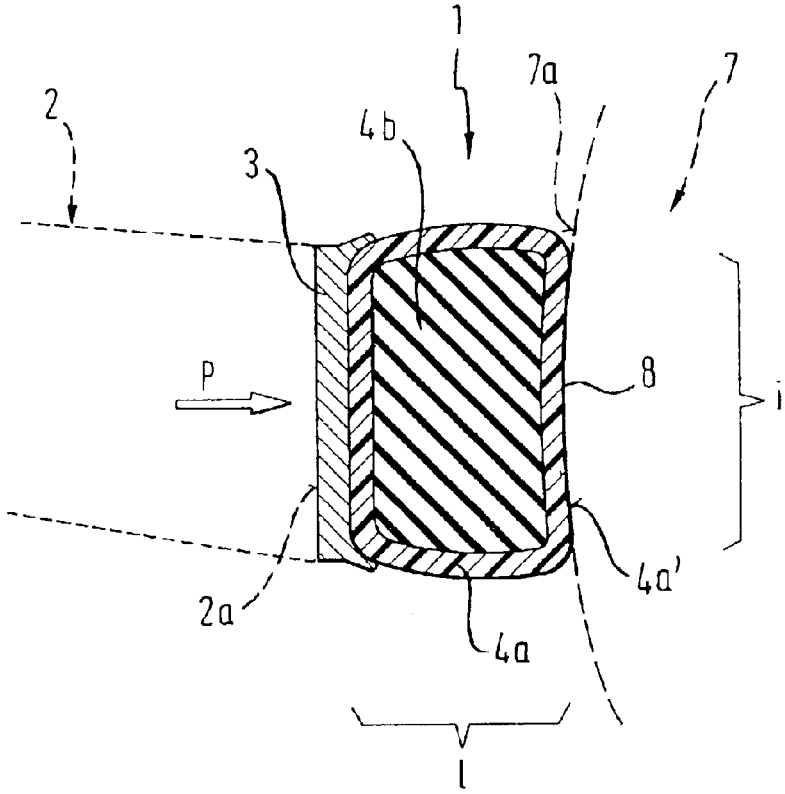
FIG. 2 is a view similar to FIG. 1, but showing the recoil pad device in a second condition in which a shooter is pressing the device against his shoulder when aiming the weapon.
Figure 3:
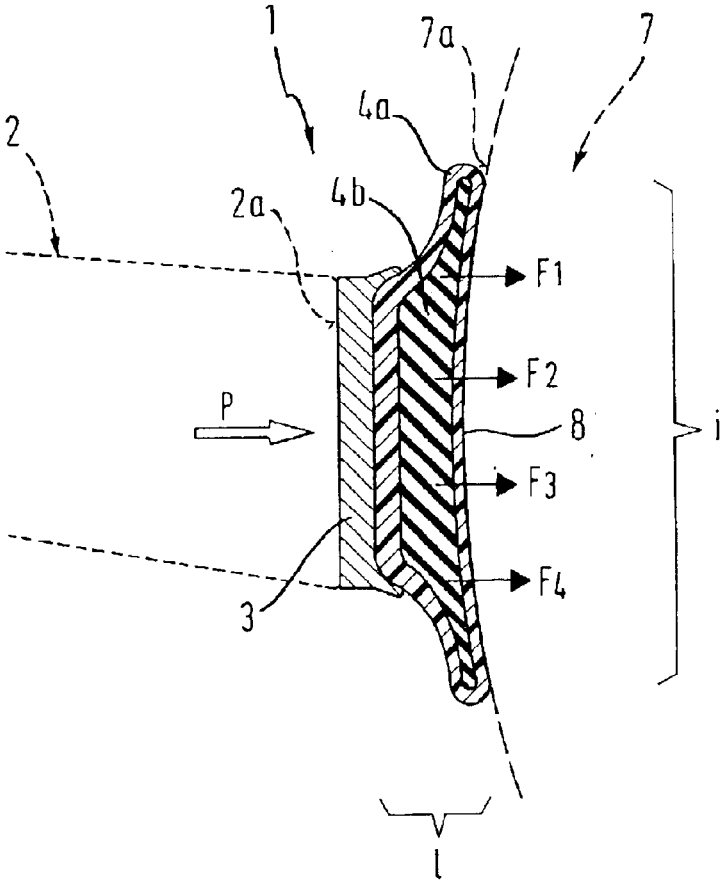
FIG. 3 is a view similar to FIGS. 1 and 2, but showing the recoil pad device in a third condition in which a shot is being fired.

FIG. 3 illustrates the example recoil pad device 1 of FIGS. 1 and 2 in a third condition when or immediately after a shot is fired from the attached rifle. The strong recoil force resulting from firing a shot presses the pad device 1 against the shoulder 7 of the shooter in the direction of the arrow P with significantly more force than applied by the shooter when aiming. As a result, the elastomer casing 4*a* and the shock-absorbing element 4*b* are significantly distorted. In the illustrated example, the pad element 4 is distorted such that its length l is approximately 2 cm (note: FIG. 3 displays the condition of maximum distortion of the pad element 4).

The distortion of the pad element 4 brings about several effects. First a portion of the recoil energy is converted into heat, which thereby decreases the recoil force being exerted on the shoulder 7 of the shooter.

Figure 6:
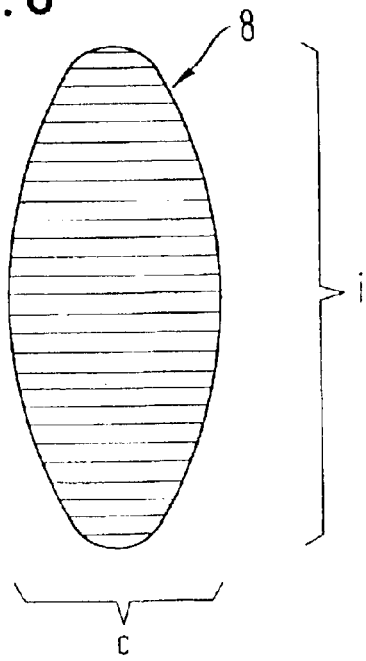
FIG. 6 illustrates the working surface of the pad device of FIG. 5 in the third condition shown in FIG. 3 in which a shot is being fired.

Second, the area of the working surface 8, (i.e. in this case the portion of the exterior surface of the elastomer casing 4*a* that touches the front shoulder surface 7*a* of the shooter), increases greatly. As a result, the illustrated working surface 8 has a clearly greater area than the back end surface 2*a* of the rifle shoulder piece 2. In the illustrated example, the working surface 8 has a height i upon firing of approximately 12 cm and, as shown in FIG. 6, a breadth c of approximately 5 cm.

The exterior contour of the working surface 8 remains generally oval when the recoil pad is distorted. As is shown in FIGS. 2 and 3, the distortion of the pad element 4 is so extreme that parts of the pad element exterior surface, which at first do not point backward (e.g., parts of the exterior surface that point upward or downward or to the side), form a portion of the rearward pointing working surface 8 when the weapon is fired.

In the example of FIG. 3, the pad element 4 is configured in such a way that the portion of the recoil force which is not absorbed by the padding of the pad element 4 is distributed substantially equally over the entire working surface 8 and conducted into the shoulder 7. For example, as shown in FIG. 3, the forces F2 and F3 entering the front shoulder surface 7*a* in the central area of the working surface 8 are substantially equal in magnitude to the forces F1 and F4 that enter the front shoulder surface 7*a* in the upper and lower end areas of the working surface 8. This substantial equality of force distribution also applies to forces entering the shoulder 7*a* on the left and right end areas of the working surface 8. This distribution of the recoil force over a relatively large working surface 8 results in significantly less pressure on the shoulder of the shooter compared to previous rifles.

After absorption and distribution of the recoil forces, the pad element 4 returns to the condition shown in FIG. 2.

An engaging mechanism (not displayed) gives the shooter the option of disconnecting the resting connection between the shoulder piece 2 and the carrier plate 3, Thus, the example recoil pad device 1 can be removed from the rifle and exchanged, if necessary.

From the foregoing, persons of ordinary skill in the art will appreciate that a recoil pad device has been disclosed which may be attached to a firearm in such a way that the working surface 8 greatly increases from a first condition in which the surface is pressed against the body of the shooter when aiming the weapon, and a second condition which occurs upon firing.

The term "working surface" 8 is used in this patent to refer generally to the part of the exterior surface of the recoil pad device 1 that touches the body of the shooter when aiming the weapon and/or firing the weapon. In particular, the working surface 8 is the surface portion over which recoil forces are transferred from the pad device 1 outward into the body of the shooter.

For example, the working surface 8 can be that portion of the surface of the pad device 1 that touches the shoulder, the cheek or the upper arm of the shooter upon aiming and/or subsequent firing of the weapon (e.g., when the device is attached to the shoulder piece of a rifle). It is also conceivable, for example, that the working surface 8 is that portion of the exterior surface of the device 1 that touches the palm of the shooter (e.g., when the device 1 is attached to the grip of a pistol or other firearm).

The illustrated recoil pad device 1 is arranged in such a way that its working surface 8 greatly increases between a first state of the device 1 where this surface 8 is pressed against the body of the shooter when aiming the weapon, and a second state of the device 1 which occurs upon subsequent firing of the weapon. This area increase causes the recoil force impacting the body upon firing to be distributed to the body across an increased surface area; which decreases the pressure that is exerted against the body upon recoil of the weapon. Firing the weapon will be perceived as "more pleasant" and less painful when the recoil force is distributed in a generally even manner over the total working surface engaging the body of the shooter.

It is advantageous to arrange the recoil pad device 1 in such a way that its working surface 8 increases by more than 15%, in particular by more than 25%, and even more preferably by more than 35% or by more than 50% or even by more than 75% upon firing of the weapon. Such a significant increase in the working surface 8 will bring about a corresponding decrease in recoil pressure.

The recoil pad device 1 can, for example, be formed integrally and be made of elastic material.

It is especially advantageous for the recoil pad device 1 to have an exterior casing 4*a* which is preferably made of an elastic material. It is especially advantageous if the exterior casing 4*a* is finished using an elastomer, (i.e., a material with elasticity similar to rubber), such as natural rubber, chlorine rubber, polybutadiene, polyurethane, or silicone rubber. Elastomers stretch up to more than twice their initial length when exposed to a pulling force. In addition to this flexibility, elastomers have a high tensile strength and stiffness, and return to their original shape after stretching. The exterior casing 4*a* of the pad device 1 is preferably configured in such a way that it will stretch by more than 15%; even more preferably by more than 30%, 50%, or 75%.

Preferably, the exterior casing 4*a* is filled with a shock-absorbing material. This shock-absorbing material converts a portion of the recoil energy to heat. An elastomer, such as rubber, can be used as a shock-absorbing material in compact or non-compact form (e.g., it may be foamed or equipped with a honeycombed structure). It is advantageous to fill the exterior casing 4*a* with a number of small absorption elements, (e.g., filled with rubber), that will move relative to each other when the pad 4 is subjected to recoil forces.

The recoil pad device 1 can be attached to a firearm, (e.g. a rifle, a machine gun, a handgun, or an automatic pistol). It is advantageous to fasten the device 1 to a shoulder piece, (e.g., on a rifle), or to a grip of a handgun.

Preferably, the carrier element on the recoil pad device 1 that is used to attach the device 1 to the firearm may be disconnected. The disconnectable connection can be arranged, for example, as a resting connection. For example, the pad device 1 can be formed in such a way that it can be attached to one of several identical firearms. A formation in which the device 1 can be attached to one of several firearms of different types (e.g., to different rifles) is also advantageous.

In an alternative configuration, the recoil pad device 1 can also be connected permanently to the weapon, (e.g. welded or riveted).

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. For use with a firearm, a recoil pad device comprising:

a pad having a working surface which increases by more than approximately 25% when moving from a first condition in which the pad is pressed against a shooter before firing and a second condition when the firearm is fired.

2. A recoil pad device as defined in claim 1 wherein the pad further comprises an exterior casing.

3. A recoil pad device as defined in claim 2 wherein the exterior casing comprises an elastomer casing.

4. A recoil pad device as defined in claim 2 wherein the exterior casing is filled with a shock-absorbing material.

5. A recoil pad device as defined in claim 1 wherein the working surface increases by more than approximately 35% when moving from the first condition to the second condition.

6. A recoil pad device as defined in claim 1 wherein the working surface increases by more than approximately 50% when moving from the first condition to the second condition.

7. A recoil pad device as defined in claim 1 wherein the working surface increases by more than approximately 75% when moving from the first condition to the second condition.

8. A firearm comprising:

a housing; and a recoil pad device secured to the housing and having a pad with a working surface which increases by more than approximately 25% when moving from a first condition in which the pad is pressed against a shooter before firing and a second condition when the firearm is fired.

9. A firearm as defined in claim 8 wherein the recoil pad device includes a carrier element to attach the recoil pad device to the housing.

10. A firearm as defined in claim 8 wherein the carrier element removably connects the recoil pad device to the housing.

11. A firearm as defined in claim 10 wherein the recoil pad device is connected to the housing via a resting connection.

* * * * *